US008534475B2

(12) United States Patent
Schipmann

(10) Patent No.: US 8,534,475 B2
(45) Date of Patent: Sep. 17, 2013

(54) SUPPORTING DEVICE FOR VERTICALLY SUPPORTING A COUPLING ROD ARTICULATED TO THE CAR BODY UNDERFRAME OF A RAIL-BORNE VEHICLE

(75) Inventor: Ralf Schipmann, Neuendorf-Sach (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 13/557,364

(22) Filed: Jul. 25, 2012

(65) Prior Publication Data

US 2013/0048589 A1 Feb. 28, 2013

(30) Foreign Application Priority Data

Aug. 23, 2011 (EP) ..... 11178426

(51) Int. Cl.
*B61G 7/10* (2006.01)

(52) U.S. Cl.
USPC ..... 213/60; 213/61

(58) Field of Classification Search
USPC ..... 213/60, 61, 62 R, 63, 64
See application file for complete search history.

(56) References Cited

U.S. PATENT DOCUMENTS 3,417,876 A * 12/1968 Stretch et al. ..... 213/60
4,105,128 A * 8/1978 Spencer ..... 213/61
4,344,541 A * 8/1982 Chierici ..... 213/61
4,376,488 A * 3/1983 Altherr ..... 213/61
4,445,618 A * 5/1984 Kulieke, Jr. ..... 213/61
4,706,826 A * 11/1987 Elliott et al. ..... 213/61
7,837,046 B2 * 11/2010 Brewster ..... 213/61
7,913,865 B2 * 3/2011 Kontetzki ..... 213/61

FOREIGN PATENT DOCUMENTS

| | | |
|---|---|---|
| EP | 1 070 645 A1 | 1/2001 |
| EP | 1 785 329 B1 | 4/2008 |
| GB | 354 640 A | 8/1931 |
| GB | 1 056 340 A | 1/1967 |
| GB | 1 152 083 | 5/1969 |
| NL | 6 613 303 | 3/1968 |

* cited by examiner

*Primary Examiner* — Jason C Smith
(74) *Attorney, Agent, or Firm* — Cesari and McKenna, LLP

(57) ABSTRACT

A supporting device for vertically supporting a coupling rod pivotably articulated in the vertical direction to a car body underframe of a rail-borne vehicle comprises a support able to be brought into contact with the coupling rod and a mount connected to the support and able to be fixed to the car body underframe of the vehicle. The support can move relative to and in the direction of the mount upon exceeding a critical external force acting on the support in the vertical direction. In order to disassociate the response curve of the supporting force from the spring characteristic of a spring element associated with the supporting device, a force-transmitting mechanism is provided enabling the at least one spring element to be coupled to the support and to the mount such that the spring element is elastically deformed by the support moving relative to the mount.

15 Claims, 9 Drawing Sheets

SUPPORTING DEVICE FOR VERTICALLY SUPPORTING A COUPLING ROD ARTICULATED TO THE CAR BODY UNDERFRAME OF A RAIL-BORNE VEHICLE

BACKGROUND OF THE INVENTION

1. Field of the Invention

The present invention relates to a supporting device in accordance with the precharacterizing part of independent claim 1.

According thereto, the invention relates in particular to a supporting device for vertically supporting a coupling rod pivotably articulated vertically to a car body underframe of a rail-borne vehicle, particularly a railway vehicle, preferably by means of an elastomer spring linkage, wherein the supporting device comprises a support able to be brought into contact with the coupling rod and a mount connected to the support and able to be fixed to the car body underframe of the vehicle, and wherein the support can move relative to and in the direction of the mount upon the exceeding of a critical force acting on said support in the vertical direction.

2. The Prior Art

A supporting device of the above type is technically already known from the prior art, and in particular from rail vehicle technology. Such a supporting device thereby serves to vertically support a coupling rod pivotably articulated vertically to a car body underframe.

FIG. 1, for example, shows a perspective view of a supporting device 110 known from the prior art which is mounted to the car body underframe 60 of a rail vehicle by means of a bearing 111. This supporting device 110 serves to vertically support a coupling rod 51 which in the example depicted in FIG. 1, is articulated to the car body underframe 60 at its car body-side end region by means of a joint arrangement 50.

In detail, the joint arrangement 50 depicted in FIG. 1 is an elastomer spring linkage as described for example in the EP 1 785 329 A1 printed publication. Such an elastomer spring linkage 50 allows the horizontal and vertical pivoting as well as axial rotation of the coupling rod 51. By so doing, the coupling rod 51 can for example realize pivoting motions relative to the car body underframe 60 as occurs particularly when a train set negotiates curves. The coupling rod 51 can furthermore follow vertical deflections, for example to compensate height differences between two coupled car bodies.

An elastomer bearing is usually configured in the linkage designed particularly as an elastomer joint arrangement 50 which provides for elastomer spring elements serving to dampen the tractive and impact forces transmitted from the coupling rod 51 under normal driving conditions. As a rule, the elastomer bearing configured in the linkage is able to allow the operationally required pivoting angle for the coupling rod 51 of approximately ±6° in the vertical direction V and approximately ±15° in the horizontal direction.

The supporting device 110 serves to vertically support the coupling rod 51 which is articulated to pivot in the vertical direction V and others. Such support in the vertical direction V is particularly necessary in order to enable the proper coupling of two adjacent car bodies. In so doing, it needs to be ensured that the coupling rod 51 is always in the horizontal central longitudinal plane during the coupling procedure.

To this end, the supporting device 110 depicted in FIG. 1 comprises a support 112 in contact with the coupling rod 51 which is connected to a mount 114 by means of a support plunger 113. The mount 114 is connected to the car body underframe 60 by means of the above-cited support 111.

The supporting device 110 is an elastically-designed support in which the support plunger 113 is connected to the mount 114 by means of a spring element 115. The support plunger 113 and the support 112 connected to the support plunger 113 are pressed against the coupling rod 51 from below in vertical direction V at a certain pretensioning by the spring element 115. The pretensioning at which the support 112 presses against the coupling rod 51 is adjustable by appropriately selecting the spring constant for the spring element 115 and should be selected such that the coupling rod 51 is in the horizontal central position when in a non-operative state; i.e. when the coupling rod 51 is not subject to any dynamic forces in the vertical direction.

The mount 111 of supporting device 110, which on the one hand serves to hold the spring element 115 and the support plunger 113, and by means of which the support 112 can be pressed against the coupling rod 51 to be supported at a certain pretensioning on the other, is rigidly connected to the car body underframe 60 or the housing of the car body underframe 60 respectively.

A direct acting spring element 115 is normally used in the supporting device 110 known from the prior art and described above to vertically support the coupling rod 51. Accordingly, the vertical supporting force introduced to the coupling rod 51 from the support 112 is essentially determined by the spring force resulting from the elastic deformation of the spring element 115. In particular, the degree of elastic deformation of the spring element 115, and thus the resulting spring force resulting from the elastic deformation of the spring element 115, increases as the vertical deflection of the coupling rod 51 increases and acts as a supporting force to counter the vertical deflection of the coupling rod 51.

This linear connection between the spring action of the spring element 115 and the supporting force of the support 112 is particularly disadvantageous in those applications where the supporting device 110 is to support a coupling rod 51 articulated to a car body underframe 60 by means of an elastomer joint arrangement 50 in the vertical direction V. Since the coupling rod 51 is already partially supported in the vertical direction V by the elastomer spring element integrated in the arrangement 50 in a coupling rod 51 articulated to a car body underframe 60 by means of an elastomer joint arrangement 50, conventional supporting devices 110 in which the supporting force increases with increasing deformation of the spring element 115 incorporated in the supporting device 110, are too rigid. In other words, such a supporting device 110 hinders the coupling rod 51 from sufficiently pivoting in the vertical direction V relative to the car body underframe 60, in consequence of which increased forces can arise in the coupling rod linkage 50 which could potentially damage the linkage 50 and/or the car body underframe 60.

SUMMARY OF THE INVENTION

Given this problem as set forth, the present invention is based on the task of further developing a supporting device of the type cited at the outset which is also in particular applicable to support a coupling rod articulated to a car body underframe by means of an elastomer spring linkage without increased forces occurring in the vertical direction during vehicle operation which could lead to damaging the joint arrangement and/or the car body underframe.

This task is solved in accordance with the invention by the subject matter of independent claim 1.

According thereto, the inventive solution proposes that the supporting device of the type cited at the outset further comprise a spring mechanism having at least one spring element which is coupled to the support and the mount of the supporting device by means of a force-transmitting mechanism such that the at least one spring element is elastically deformed by the support moving relative to the mount, whereby the force-transmitting mechanism is designed to convert a spring force resulting from the elastic deformation of the at least one spring element into an external force acting against the supporting force directed at the support.

The advantages attainable with the present invention are obvious: Providing a force-transmitting mechanism ensures the spring force of the supporting device resulting from the elastic deforming of the at least one spring element is not transmitted directly to the support to there counter the external force acting vertically on the support as a supporting force. Instead, the inventive supporting device utilizes a mechanism which converts the spring force resulting from the elastic deformation of the at least one spring element of the supporting device into the supporting force which counters the external force acting on the support. The relationship between the spring force of the at least one spring element and the supporting force ultimately acting on the coupling rod to be supported in the vertical direction is defined by the design of the force-transmitting mechanism. In particular, the response and spring characteristics of the supporting force exerted by the supporting device on the coupling rod to be supported are adaptable to the specific application so that particularly also such vertical supporting forces as are exerted for example by an elastomer spring arrangement provided in the coupling rod linkage can be taken into account as well.

The force transmission preferably comprises a mechanism with which the distance traveled by the support relative to the mount upon moving can be converted into a spring deflection which elastically deforms the at least one spring element upon the support moving relative to the mount. This embodiment enables the response curve of the supporting force to be disassociated from the spring characteristic of the at least one spring element. In applications in which a coupling rod articulated by means of an elastomer spring linkage is to be supported in the vertical direction, it is particularly advantageous for the force-transmitting mechanism to be designed such that there will be an asynchronous correlation between the response curve of the supporting force and the spring characteristic of the at least one spring element so that the supporting force decreases in at least one operative area of the supporting device the more the at least one spring element of the supporting device is elastically deformed.

It is conceivable to provide the force-transmitting mechanism with a gearing arrangement, for example, with which the spring force resulting from the elastic deformation of the at least one spring element is converted into supporting force introduced from the support into the coupling rod to be supported in the vertical direction. Technically simpler and particular less prone to failure, however, is a force-transmitting mechanism which comprises at least one shears mechanism consisting of a single shears having two arms of equal length, wherein said two arms are movable relative each other about a common horizontal axis running through the centers of the arms. In this realization of the force-transmitting mechanism, each arm is connected on one side to the mount by means of a fixed bearing and on the other to the support by means of a floating bearing. The at least one spring element is thereby configured as a pressure spring and engages at a first arm of the two arms of equal length on the one side and the second arm of the two arms of equal length on the other.

In this embodiment of the force-transmitting mechanism, it is of particular advantage to be able to adjust a pretensioning of the at least one spring element. This can occur for example by the at least one spring element configured as a pressure spring being connected to the first and/or second arm by means of a first and second stop, wherein reducing the distance between the two stops will increase the pretensioning of the spring element.

The term "fixed bearing" as used herein refers to a bearing with which a shear arm of the shears mechanism is connected to the mount, the support respectively, of the supporting device such that the arm can rotate relative to the support/mount of the supporting device about one horizontal axis while the other two degrees of translational freedom are fixed.

The term "floating bearing" as used herein refers to a bearing fixed in one degree of translational freedom, wherein the arm can rotate relative to the support, the mount respectively, as well as move in the longitudinal direction of the support/mount.

A floating bearing is preferably realized by means of an elongated hole extending in the longitudinal direction of the support/mount.

Alternatively to the latter embodiment in which the force-transmitting mechanism comprises a shears mechanism consisting of a single shears, a preferred further development of the solution according to the invention provides for the force-transmitting mechanism to comprise at least one double shears mechanism consisting of first and second shears. Each of the shears of the double shears mechanism thereby exhibits two arms of equal length which are movable relative each other about a common horizontal axis running through the centers of the two arms. The respective first arm of each of the shears of the double shears mechanism is connected to the support by means of a fixed bearing and to the mount by means of a floating bearing. The second arm of each of the shears of the double shears mechanism is connected to the mount by means of a fixed bearing and to the support by means of a floating bearing. In this realization of the force-transmitting mechanism, the at least one spring element is configured as a tension spring and is to engage directly or indirectly at least one arm of the first of the shears on the one side and at least one arm of the second of the shears on the other.

An advantageous further development of the latter embodiment in which the supporting device comprises a force-transmitting mechanism having a double shears mechanism provides for the longitudinal axis of the at least one spring element configured as a tension spring to lie in a horizontal axis extending perpendicular to the horizontal axis about which the arms of the first of the shears of the double shears mechanism can move relative to each other on the one hand and extending perpendicular to the horizontal axis about which the arms of the second shears of the double shears mechanism can move relative to each other on the other. Doing so thus achieves an especially compactly designed supporting device. However, other embodiments to this effect are of course also conceivable.

In order to be able to adjust the support's operative point; i.e. the operative point on the response curve of the supporting force, to be for example contingent upon the specific application in a supporting device in which the force-transmitting mechanism comprises a double shears mechanism, a preferred further development of the latter embodiment provides for arranging the at least one spring element configured as a tension spring between a first and a second counter bearing, wherein the distance between the first and the second counter bearing is adjustable, and wherein the at least one spring element configured as a tension spring is already in a pretensioned state at the maximum distance between the first and second counter bearing when there is no external force acting on the support in the vertical direction.

Another advantageous realization of the force-transmitting mechanism utilized in the inventive supporting device provides for the at least one double shears mechanism to consist of a first and second shears, wherein—as is also the case with the above-indicated embodiment—each of the shears of the double shears mechanism exhibits two arms of equal length which can move relative to each other about a common horizontal axis running through the centers of the two arms, wherein the respective first arm of one of the respective shears of the double shear arrangement is connected to the support by means of a fixed bearing and to the mount by means of a floating bearing and the second arm of the respective shears of the double shears mechanism is connected to the mount by means of a fixed bearing and to the support by means of a floating bearing. In contrast to the embodiment discussed above, however, the at least one spring element here is configured as a pressure spring and arranged between a first bolt situated in the horizontal axis about which the arms of the first of the shears of the double shears mechanism can move relative to each other and a counter bearing, wherein said counter bearing is connected to a second bolt by means of a tension rod situated on the horizontal axis about which the arms of the second of the shears of the double shears mechanism can move relative to each other.

The first bolt is preferably connected to the arms of the first of the shears of the double shears mechanism and the second bolt preferably connected to the arms of the second of the shears of the double shears mechanism such that the respective arms are pivotable relative to the bolts.

A preferred realization of the latter embodiment provides for the at least one spring element to be configured as a pressure spring washer through which the tension rod at last partially extends, wherein the counter bearing comprises a first counter element, in particular a nut, arranged at a first end region of the tension rod, and a second counter element, in particular a nut, arranged at an opposite second end region. The at least one spring element configured as a pressure spring washer is thereby tensioned between the first counter element and the first bolt. It is thereby advantageously provided for the distance between the first counter element and the second counter element to be variable in order to be able to adjust the pretensioning of the at least one spring element and thus the support's operative point.

Providing for the spring mechanism to comprise at least one first and one second spring element, each configured as a pressure spring washer, is even more preferred with the latter embodiment, wherein the at least one first spring element is arranged between the first counter element and the first bolt and the at least one second spring element is arranged between the second counter element and the second bolt.

It is hereby conceivable for the at least one first spring element to be accommodated in a first spring housing connected to the first bolt and for the at least one second spring element to be accommodated in a second spring housing connected to the second bolt. Said spring housings concurrently assume guidance of the correspondingly accommodated spring elements.

Lastly, it is preferred for the mount of the supporting device to comprise a flange area with which the supporting device can be attached, preferably detachably, to the car body underframe of the vehicle. The supporting device is thus suited to subsequent retrofitting which would then be the case, for example, when a close coupler normally disposed between two car bodies of a multi-member railway vehicle needs to be disconnected and the individual car bodies towed away.

BRIEF DESCRIPTION OF THE DRAWINGS

Reference will be made in the following to the accompanying drawings in describing an example embodiment of the solution according to the invention.

Shown are.

DESCRIPTION OF A PREFERRED EMBODIMENT

Figure 1:
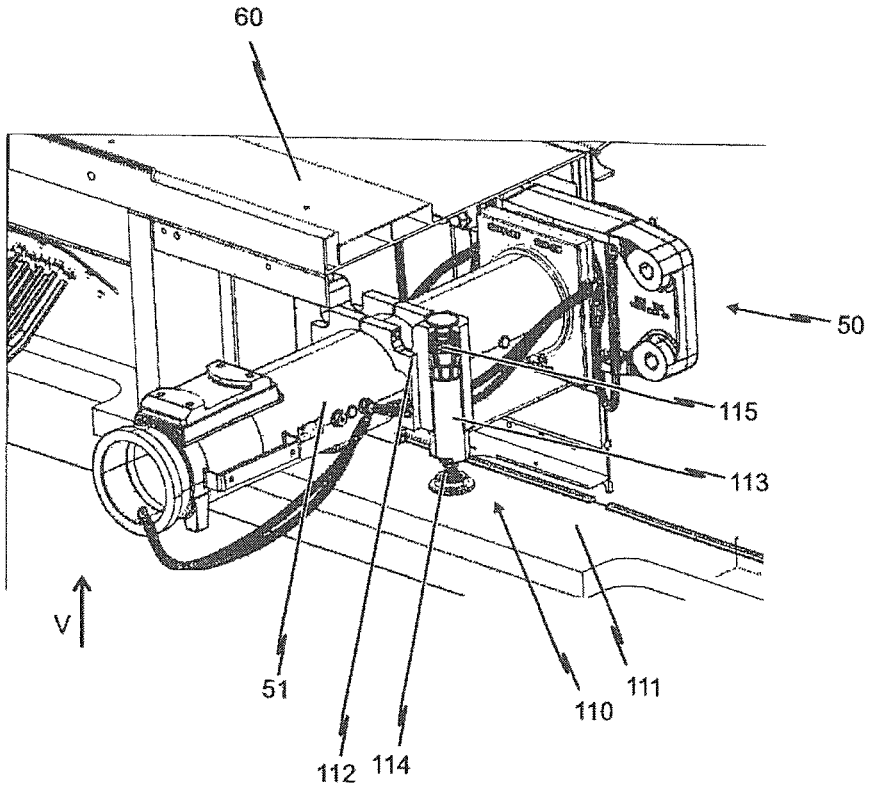
Fig. 1 (Prior Art)
FIG. 1, already described, a perspective view of a supporting device known from the prior art.

FIG. 1 depicts a known prior art supporting device 110 serving to vertically support a coupling rod 51 articulated to a car body underframe 60 by means of an elastomer joint arrangement 50. As already noted in the introductory part of the description, this conventional supporting device 110 comprises a spring element 115 in the form of a helical pressure spring which is arranged between a support 112 and a mount 114 and presses the support 112 toward the coupling rod 51 to be vertically supported. The mount 114 itself is supported on the car body underframe 60 by means of a bearing 111.

Accordingly, a system with a directly acting helical pressure spring 115 is utilized for the vertical support of the coupling rod 51 in the conventional supporting device 110 depicted in FIG. 1, wherein the spring force resulting from the elastic deformation of the spring element 115 configured as a helical pressure spring corresponding to the characteristic curve of the spring element 115 continues to increase with increasing vertical deflection of the coupling rod 51. This phenomenon occurs regardless of whether a helical pressure spring made from metal or an elastomer spring made e.g. from rubber or a differently designed spring is used as the spring element 115.

The conventional design of the supporting device 110 does not allow the vertical supporting force exerted on the coupling rod 51 by said supporting device 110 to be adapted to the specific application. In particular, the vertical support of a coupling rod 51 cannot be optimized for the conventional supporting device 115 when same for example is already experiencing a vertical supporting force by means of an elastomer mechanism integrated in the joint arrangement 50. The same also holds true for coupling rods 51 which are articulated to the car body underframe 60 of a vehicle by means of a spherical bearing.

To resolve these disadvantages, it is inventively proposed to disassociate the vertical supporting force to be introduced by the supporting device into the coupling rod to be supported by the appropriate mechanism from the spring characteristic of the at least one spring element in order to thus be able to achieve an advantageous force profile for the respective application.

Reference will be made in the following to the accompanying drawings in describing possible realizations of the inventively proposed force-transmitting mechanism in greater detail.

Figure 2:
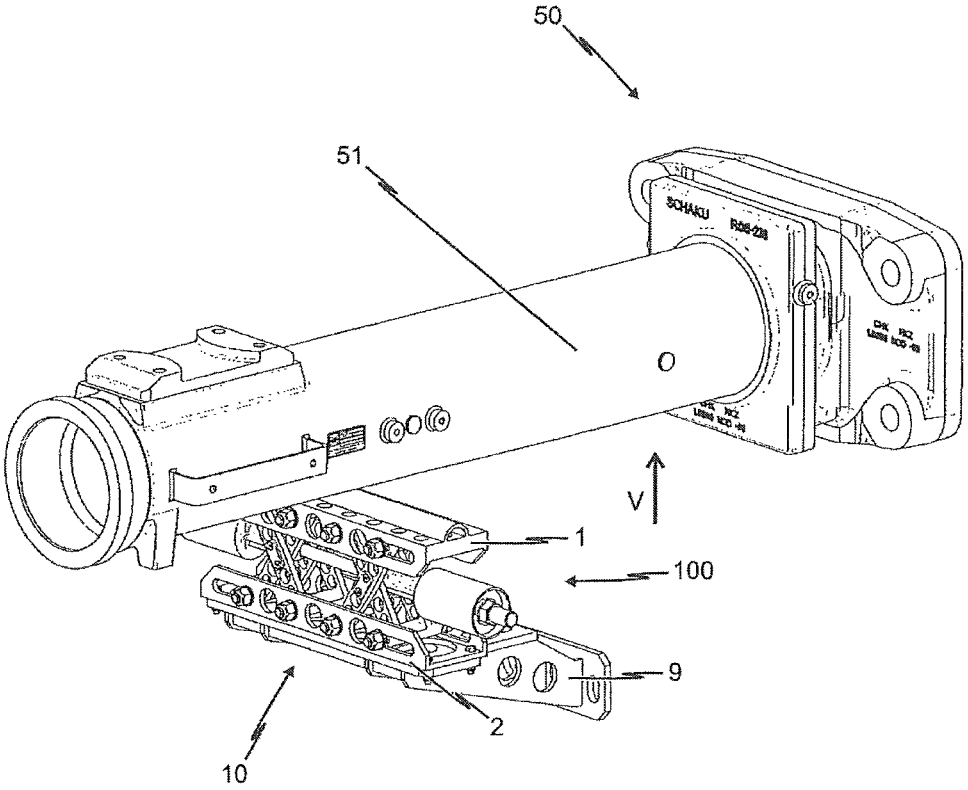
FIG. 2 a perspective view of an example embodiment of the inventive supporting device in the installed state.

FIG. 2 shows in detail a first example embodiment of a supporting device 100 in the installed state in which a coupling rod 51 is supported in vertical direction V by means of supporting device 100. In the FIG. 1 embodiment, the coupling rod 51 is connected to a (not explicitly shown) car body underframe of a rail-borne vehicle, a railway vehicle in particular, by means of an elastomer joint arrangement 50. Reference will be made in the following to the FIG. 3 depiction in describing the design of the elastomer joint arrangement 50 in greater detail.

Figure 3:
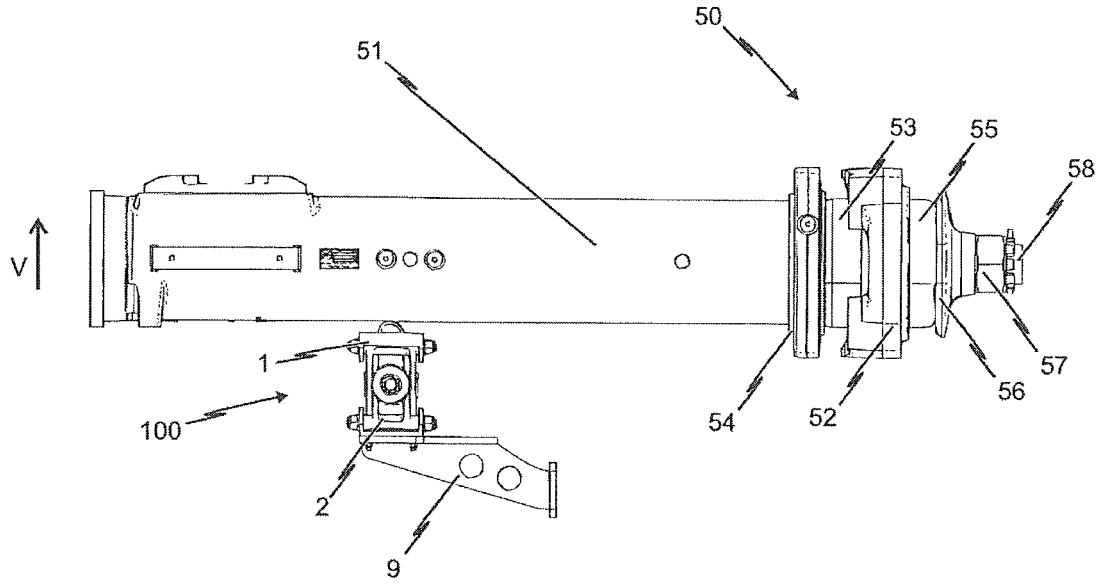
FIG. 3 a side view of the supporting device according to FIG. 2.

It can be specifically noted from the FIG. 3 depiction that the elastomer joint arrangement 50 comprises a base plate 52 which can be connected to the car body underframe of the vehicle, by means of which the tractive and impact forces transmitted via the coupling rod 51 when the vehicle is in operation are introduced to the car body underframe. The elastomer joint arrangement 50 further comprises a tension rod-side front elastomer spring element 53 between a tension rod-side front spring plate 54 and the pressure plate 52 as well as a car body-side rear elastomer spring element 55 between the pressure plate 52 and a rear spring plate 56, wherein said elastomer spring elements 53, 55 are accordingly tensioned. The rear spring plate 56 is fixed to a centerpiece 58 by means of a locknut 57, wherein said centerpiece 58 runs through the elastomer spring elements 53, 55 configured as hollow rubber springs as well as through corresponding passage openings provided in the spring plates 54, 56 and the base plate 52 and is connected to the coupling rod 51.

The linkage 50 configured as an elastomer spring joint not only allows the damping of tractive and impact forces transmitted via the coupling rod 51 during operation but also effects a vertical support of the coupling rod 51, although it is insufficient to hold the coupling rod 51 in the horizontal central longitudinal plane in the uncoupled state.

Figure 4A:
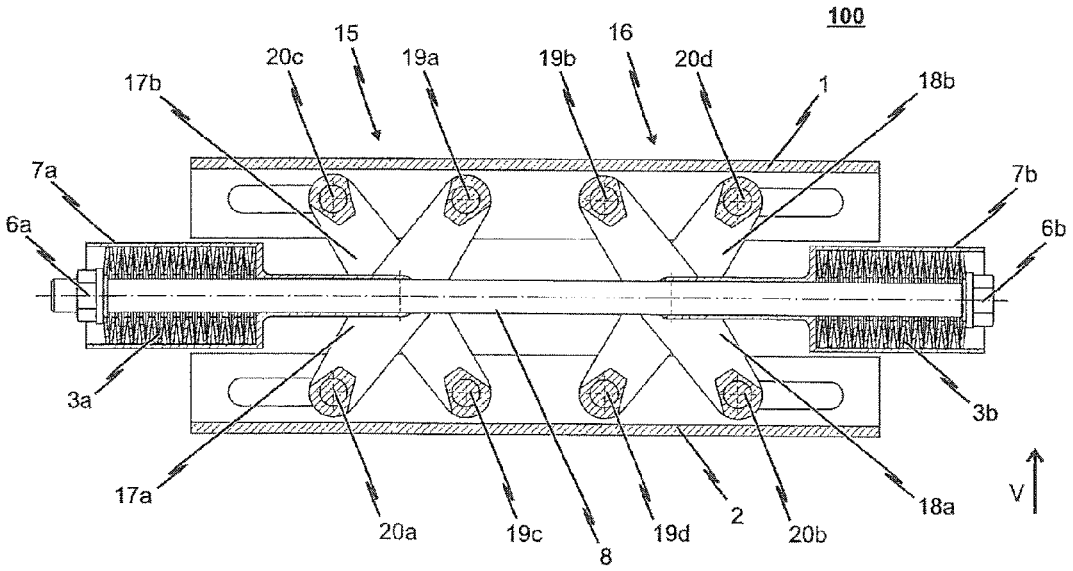
FIG. 4*a* a longitudinal sectional view of the supporting device according to FIG. 1 in the unloaded state.
Figure 4B:
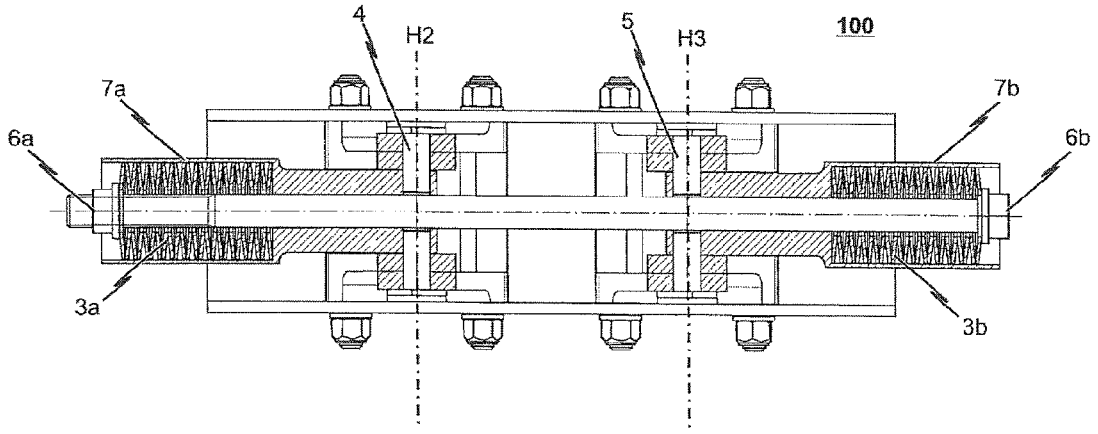
FIG. 4*b* a plan view of the supporting device according to FIG. 4*a* depicted in a longitudinal sectional view.
Figure 4C:
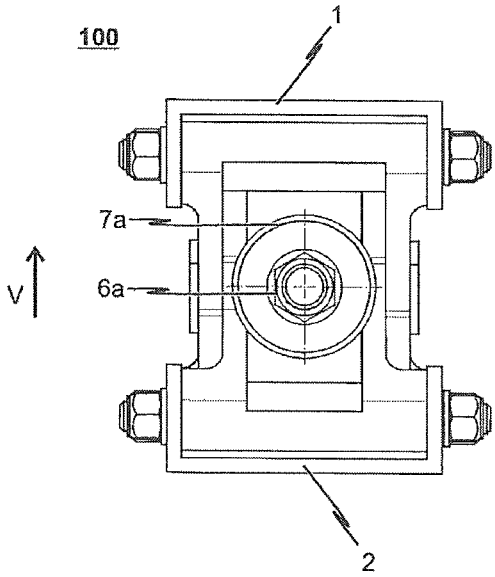
FIG. 4*c* a view of the front end of the supporting device according to FIG. 4*a;*
Figure 4D:
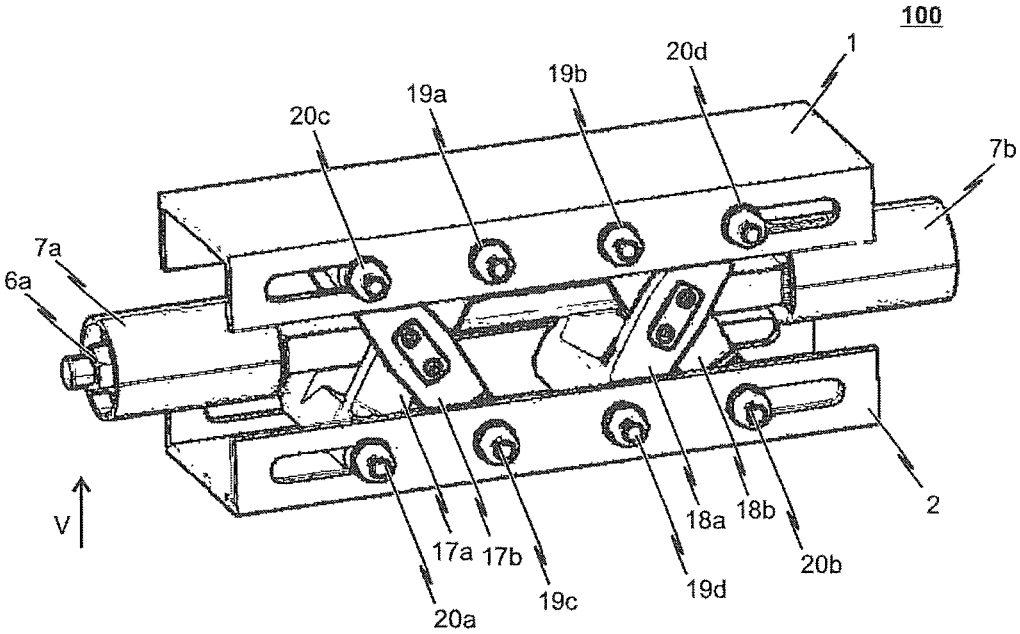
FIG. 4*d* a perspective view of the supporting device according to FIG. 4*a;*
Figure 4E:
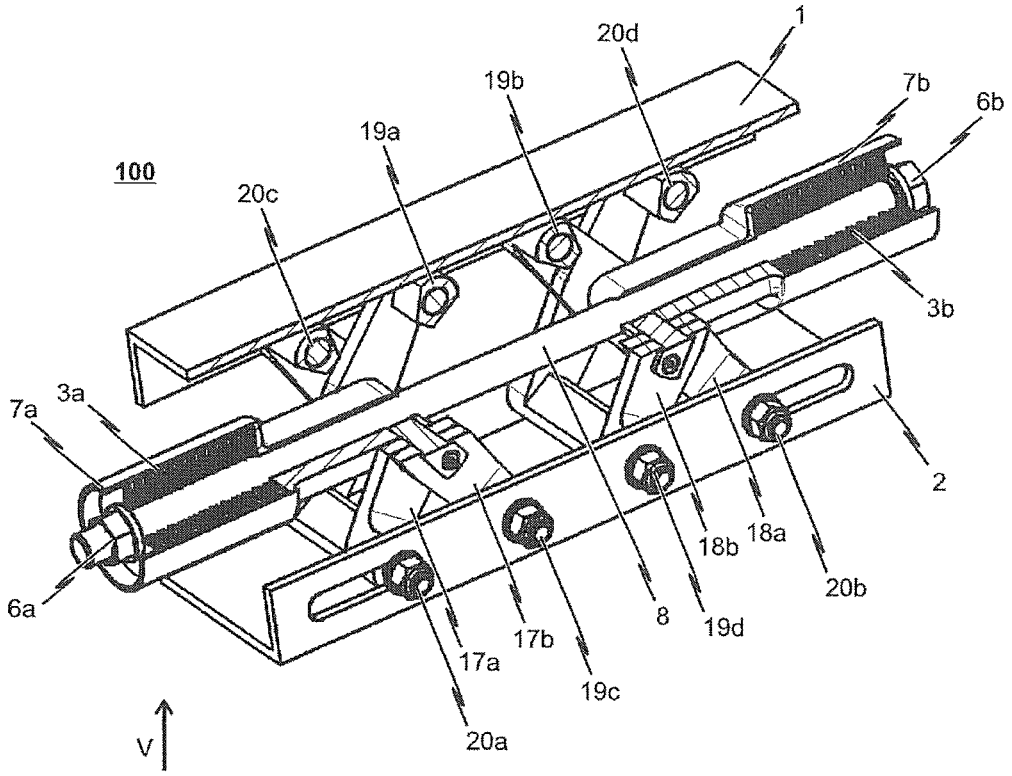
FIG. 4*e* a partly sectional perspective view of the supporting device according to FIG. 4*a;*
Figure 5A:
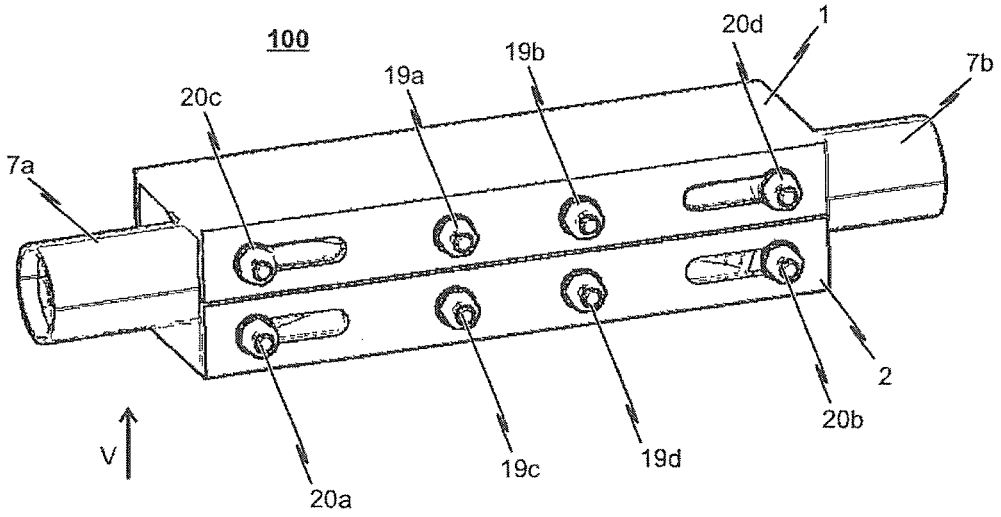
FIG. 5*a* a perspective view of the supporting device according to FIG. 1 in a loaded state after the vertical supporting capacity of the supporting device is exhausted.
Figure 5B:
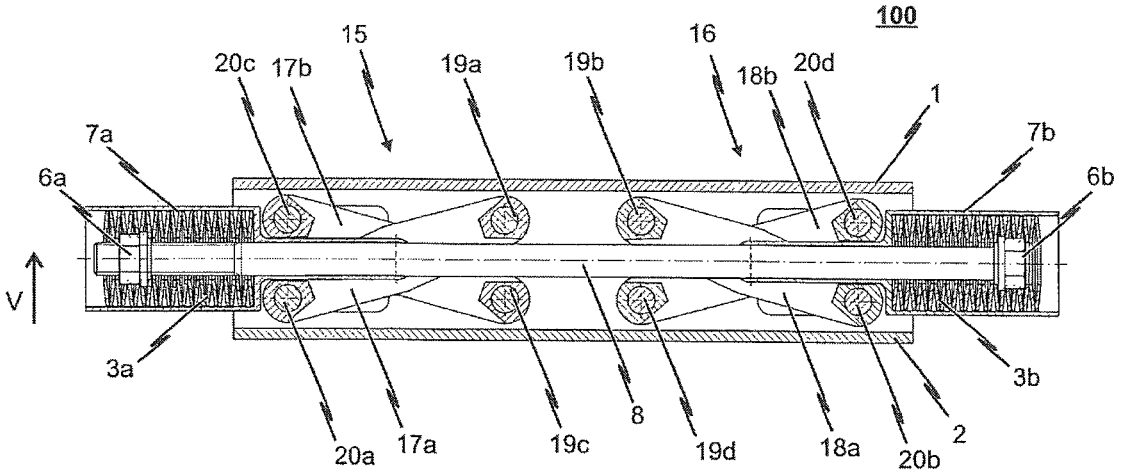
FIG. 5*b* a longitudinal sectional view through the supporting device according to FIG. 5*a;*

To that end, the embodiment makes use of the inventive supporting device 100 depicted in FIGS. 2 and 3, which—as can especially be noted from the representations provided in FIGS. 4 and 5—comprises a support 1 able to be brought into contact with the coupling rod 51 to be supported as well as a mount 2 connected to the support 1 and affixable to the car body underframe of the vehicle. As depicted, the support 1 can be configured as a platform and the mount 2 as a base frame. Providing recesses in the appropriate areas of the support 1 configured as a platform and/or the mount 2 configured as an base frame hereby lends itself particularly well to reducing the overall weight of the supporting device 100.

The mount 2 is connected to a flange area 9 or respectively comprises a flange area 9 (see FIGS. 2 and 3) by means of which the supporting device 100 can be attached, preferably detachably, to the car body underframe of the vehicle.

A force-transmitting mechanism 10 is employed in the example embodiment in accordance with FIGS. 2 to 5 in order to disassociate the supporting force exerted by the supporting device 100 on the coupling rod 51 to be supported in vertical direction V from the spring characteristic of a spring element of supporting device 100. The spring elements 3*a*, 3*b* provided in the supporting device 100 in accordance with FIGS. 2 to 5 are coupled to the support 1 and the mount 2 by means of said force-transmitting mechanism 10 and thereby in such manner that said spring elements 3*a*, 3*b* will elastically deform upon the support 1 moving relative to mount 2.

As will be described in grater detail below with reference to the depictions provided in FIGS. 4 and 5, the force-transmitting mechanism 10 is particularly designed to convert the spring force resulting from the elastic deformation of the spring elements 3*a*, 3*b* into a supporting force acting in vertical direction V.

In detail, the force-transmitting mechanism 10 in the embodiment depicted in FIGS. 2 to 5 comprises a double shears mechanism consisting of a first and second shears 15, 16. Each of the shears 15, 16 of the double shears mechanism consists of two arms 17*a*, 17*b*; 18*a*, 18*b* of equal length which can move relative to each other about a common horizontal axis H2, H3 extending through the centers of the two arms 17*a*, 17*b*, 18*a*, 18*b*. Each respective first arm 17*a*, 18*a* of each of the respective shears 15, 16 is connected to the support 1 by means of a fixed bearing 19*a*, 19*b* and to the mount 2 by means of a floating bearing 20*a*, 20*b*, whereas the respective second arm 17*b*, 18*b* of each of the respective shears 15 is connected to the mount 2 by means of a fixed bearing 19*c*, 19*d* and to the support 1 by means of a floating bearing 20*c*, 20*d*.

Employing a total of two double shears mechanisms of the type described above is particularly provided in the embodiment depicted in FIGS. 2 to 5, whereby each respective double shears mechanism is arranged on a side of the supporting device 100.

The spring elements 3*a*, 3*b* are configured as a pressure spring system and are situated between a first bolt 4 and a counter bearing in the depicted embodiment. The first bolt 4 lies on horizontal axis H2 about which the arms 17*a*, 17*b* of the first of the shears 15 of the double shears mechanism can move relative to each other. Specifically, the first bolt 4 is connected to the two arms 17*a*, 17*b* of the first of the shears 15 such that the arms 17*a*, 17*b* can rotate about the horizontal axis H2 relative to the first bolt 4. A fixed bearing is again employed to this end. The counter bearing is connected to a second bolt 5 by means of a tension rod 8, whereby said second bolt 5 lies on horizontal axis H3 about which the arms 18*a*, 18*b* of the second of the shears 16 of the double shears mechanism can move relative to each other. Specifically, the arms 18*a*, 18*b* of the second of the shears 16 are connected to the second bolt 5 by means of a fixed bearing such that the arms 18*a*, 18*b* can rotate about the horizontal axis H3.

As can particularly be noted from the partially sectional perspective depiction in FIG. 4*e*, the spring elements 3*a*, 3*b* are each configured as a pressure spring washer system through which the tension rod 8 at least partly extends, wherein the counter bearing comprises a first counter element 6*a* in the form of a nut arranged at a first end region of the tension rod 8 and a second counter element 6*b*, likewise in the form of a nut, arranged at an opposite second end region of tension rod 8. The first spring element 3*a* configured as a pressure spring washer system is thereby arranged between the first counter element 6*a* and the first bolt 4, whereas the second spring element 3*b*, likewise configured as a pressure spring washer system, lies between the second counter element 6*b* and the second bolt 5. By tightening the counter elements 6*a*, 6*b* configured as nuts, the distance between the first counter element 6*a* and the second counter element 6*b* can be varied in order to adjust the pretensioning of the spring elements 3*a*, 3*b* configured as a pressure spring washer system.

In detail, the spring elements 3*a*, 3*b* configured as a pressure spring washer system are tensioned between the respective counter elements 6*a*, 6*b* and the base of a spring housing 7*a*, 7*b* of cup-shaped design. The respective spring housings 7*a*, 7*b* are connected to the first bolt 4 and the second bolt 5 respectively.

The providing of such a force-transmitting mechanism 10 converts the distance traveled by the support 1 upon the displacing relative to the mount 2 into a spring deflection elastically deforming the two spring elements 3*a*, 3*b* upon the support 1 moving relative the mount 2. Particularly realized is a transmission of force with which the response curve of the supporting force is independent of the spring characteristics of spring elements 3*a*, 3.

Figure 6:
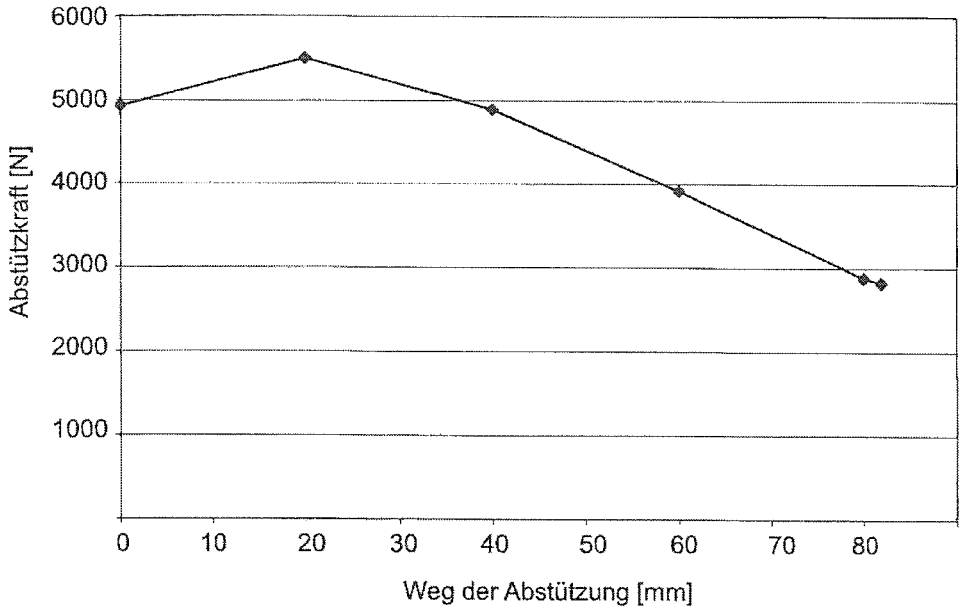
FIG. 6 a force/path diagram of the supporting device according to FIG. 1.

FIG. 6 depicts a force/path diagram of a supporting device 100 comprising a force-transmitting mechanism 10 as employed in the first example embodiment according to FIGS. 2 to 5.

Accordingly, upon an external force being exerted in the vertical direction on the support 1, the supporting force initially increases and then drops almost linearly after peaking. This thus enables there to be an asynchronous (non-linear) correlation between the response curve of the supporting force and the spring characteristics of the spring elements 3*a*, 3*b* for the force-transmitting mechanism 10, and specifically one in which the supporting force decreases in at least one operative area of the supporting device 100 the more the spring elements 3*a*, 3*b* of the supporting device 100 are elastically deformed.

The supporting device 100 according to the invention is thus particularly suited to (temporarily) supporting a coupling rod 51, for example a close coupler, when said coupling rod is articulated to the car body underframe of a vehicle by means of an elastomer spring joint arrangement 50 as described for example in the EP 1 785 329 B1 printed publication. Since close couplers are not usually equipped with vertical supporting devices, the coupling rod is only held at the bearing point by the elastomer spring joint arrangement and drops out of the horizontal central longitudinal plane when the coupling rod 51 is not connected to the coupling rod of a neighboring car body. This accordingly lends itself in this case to the inventive device 100 being mounted to the vehicle underframe in order to support the coupling rod 51 in the vertical direction as for example required when towing the car body. In so doing, the spring elements 3*a*, 3*b* are to be adjusted by tightening the counter elements 6*a*, 6*b* configured as nuts such that the support 1 bears against the coupling rod 51. Further tightening of the counter elements 6*a*, 6*b* can additionally apply a pretensioning force.

An adapter coupler, for example, can thereafter be mounted to the coupling rod 51 in order to allow the vehicle to be towed. The inventive supporting device 100 thereby allows a vertical movement of the coupling rod 51 relative to the car body underframe during operation.

The inventive solution is not limited to the specific embodiment of the supporting device 100 described above with reference to the FIGS. 2 to 5 depictions. It is in particular conceivable to use a spring element 3*c* configured as a tension spring system instead of the spring elements 3*a*, 3*b* configured as pressure spring system, said spring element 3*c* engaging on the one side with at least one arm 17*a*, 17*b* of the first of the shears 15 of the double shears mechanism and with at least one arm 18*a*, 18*b* of the second of the shears 16 of the double shears mechanism on the other as suggested in FIG. 7.

Figure 7:
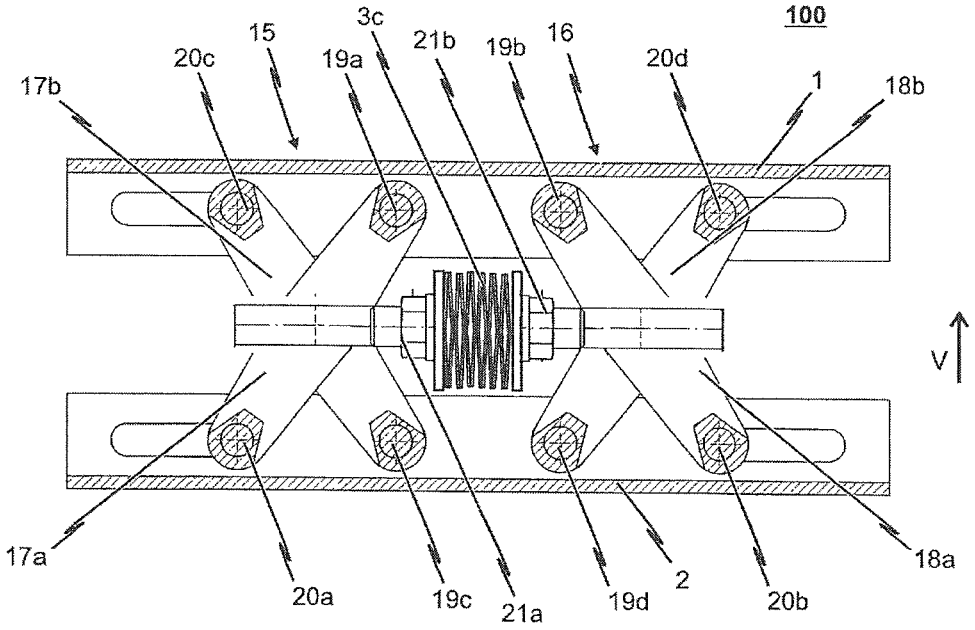
FIG. 7 a longitudinal sectional view of a further example embodiment of the inventive supporting device in the unloaded state.

Specifically, in the embodiment depicted in FIG. 7, the longitudinal axis of the spring element 3*c* configured as a tension spring system lies on a horizontal axis which, on the one hand, runs perpendicular to the horizontal axis H2 about which the arms 17*a*, 17*b* of the first of the shears 15 can move relative to each other and, on the other, perpendicular to the horizontal axis H3 about which the arms 18*a*, 18*b* of the second of the shears 16 can move relative to each other.

In order to be able to adjust the operative point of the supporting force in the embodiment of the supporting device 100 depicted in FIG. 7, the spring element 3*c* configured as a tension spring system is arranged between a first and a second counter bearing 21*a*, 21*b*, wherein the distance between the first and the second counter bearing 21*a*, 21*b* can be adjusted accordingly.

In a further structurally simple realization of the inventive solution, a shears mechanism consisting of a single shears is employed as the force-transmitting mechanism 10, wherein said single shears comprises two arms of equal length which can move relative to each other about a common horizontal axis extending through the centers of the two arms. Each arm of the single shears is thereby connected on one side to the mount by means of a fixed bearing and on the other to the support by means of a floating bearing. A spring element configured as a pressure spring or pressure spring system thereby engages at the first arm of the two equal-length arms of the single shears on one side and at the corresponding second arm of the two equal-length arms on the other.

LIST OF REFERENCE NUMERALS

1 support
2 mount
3*a, b, c* spring element
4 first bolt
5 second bolt
6*a, b* counter element
7*a, b* spring housing
8 tension rod
9 flange area
10 force-transmitting mechanism
12*a*, 12*b* fixed bearing
13*a*, 13*b* floating bearing
15, 16 shears of a double shears mechanism
17*a*, 17*b* arm of shears 15
18*a*, 18*b* arm of shears 16
19*a*, 19*b* fixed bearing
20*a*, 20*b* floating bearing
21*a*, 21*b* counter bearing
50 elastomer spring linkage
51 coupling rod
52 base plate
53 front elastomer spring element
54 spring plate
55 rear elastomer spring element
56 spring plate
60 car body underframe
100 supporting device
110 supporting device (prior art)
111 bearing (prior art)
112 support (prior art)
113 support plunger (prior art)
114 mount (prior art)
115 spring element (prior art)
V vertical direction
H2, H3 horizontal axis

What is claimed is:

1. A device for vertically supporting a coupling rod pivotably articulated vertically to a car body underframe of a rail-borne vehicle, the device comprising:

a support and a mount coupled to the support, wherein the support is configured to move relative to and in a direction of the mount when a critical external force acting on said support in a vertical direction is exceeded;

a spring mechanism having at least one spring element coupled to the support and the mount by means of a force-transmitting mechanism, wherein the at least one spring element is elastically deformed by the support moving relative to the mount, and wherein the force-transmitting mechanism converts a spring force resulting from an elastic deformation of the at least one spring element into a supporting force opposite to a force acting on the support; and at least one shears mechanism of the force-transmitting mechanism consisting of shears, wherein the shears include two arms of equal length which are movable relative to each other about a common horizontal axis running through centers of the two arms, wherein each of the two arms are connected on one side to the mount by means of a fixed bearing and on an other side to the support by means of a floating bearing, and wherein the at least one spring element is configured as a pressure spring and engages at a first arm of the two arms of equal length on the one side and the second arm of the two arms of equal length on the other side.

2. The device according to claim 1, wherein the force-transmitting mechanism is designed to convert a distance traveled by the support moving relative to the mount into a spring deflection which elastically deforms the at least one spring element upon the support moving relative to the mount.

3. The device according to claim 1, wherein the force-transmitting mechanism is configured to provide an asynchronous correlation between a response curve of the supporting force and a spring characteristic of the at least one spring element so that the supporting force decreases in at least one operative area of the supporting device the more the at least one spring element is elastically deformed.

4. The device according to claim 1, wherein a pretensioning of the at least one spring element is configured to be adjusted.

5. The device according to claim 1, wherein the mount comprises a flange area with which the supporting device can be attached, preferably detachably, to the car body underframe of the vehicle.

6. The device according to claim 1, wherein the support is configured as a platform and the mount is configured as an base frame.

7. A device for vertically supporting a coupling rod pivotably articulated vertically to a car body underframe of a rail-borne vehicle, the device comprising:

a support and a mount coupled to the support, wherein the support is configured to move relative to and in a direction of the mount when a critical external force acting on said support in a vertical direction is exceeded;

a spring mechanism having at least one spring element coupled to the support and the mount by means of a force-transmitting mechanism, wherein the at least one spring element is elastically deformed by the support moving relative to the mount, and wherein the force-transmitting mechanism is converts a spring force resulting from an elastic deformation of the at least one spring element into a supporting force opposite to a force acting on the support; and at least one double shears mechanism of the force-transmitting mechanism consisting of a first shear and a second shear, wherein each of the first shear and second shear of the double shears mechanism includes two arms of equal length movable relative to each other about a common horizontal axis extending through centers of the two arms, wherein a respective first arm of each of the shears is connected to the support by means of a first fixed bearing and to the mount by means of a first floating bearing and a second arm of each of the shears is connected to the mount by means of a second fixed bearing and to the support by means of a second floating bearing, and wherein the at least one spring element is configured as a tension spring and engages at least one arm of the first of the shears on the one side and at least one arm of the second of the shears on the other side.

8. The device according to claim 7, wherein a longitudinal axis of the at least one spring element configured as a tension spring lies in a horizontal axis extending perpendicular to the horizontal axis about which the two arms of the first shear can move relative to each other and extend perpendicular to the horizontal axis about which the two arms of the second shear can move relative to each other.

9. The device according to claim 8, wherein the at least one spring element configured as a tension spring is arranged between a first counter bearing and a second counter bearing, wherein a distance between the first counter bearing and the second counter bearing is adjustable, and wherein the at least one spring element configured as a tension spring is in a pretensioned state at a maximum distance between the first counter bearing and second counter bearing when there is no external force acting on the support in the vertical direction.

10. A device for vertically supporting a coupling rod pivotably articulated vertically to a car body underframe of a rail-borne vehicle, the device comprising:

a support and a mount coupled to the support, wherein the support is configured to move relative to and in a direction of the mount when a critical external force acting on said support in a vertical direction is exceeded;

a spring mechanism having at least one spring element coupled to the support and the mount by means of a force-transmitting mechanism, wherein the at least one spring element is elastically deformed by the support moving relative to the mount, and wherein the force-transmitting mechanism is converts a spring force resulting from an elastic deformation of the at least one spring element into a supporting force opposite to a force acting on the support; and at least one double shears mechanism of the force-transmitting mechanism consisting of a first shear and a second shear, wherein each of first shear and the second shear of the double shears mechanism includes two arms of equal length moveable relative to each other about a common horizontal axis running through centers of the two arms, wherein a respective first arm of each of the shears is connected to the support by means of a first fixed bearing and to the mount by means of a first floating bearing and a second arm of each of the shears is connected to the mount by means of a second fixed bearing and to the support by means of a second floating bearing, and wherein the at least one spring element is configured as a pressure spring and arranged between a first bolt situated in a horizontal axis about which the two arms of the first shear are movable relative to each other and a counter bearing connected to a second bolt by means of a tension rod situated on the horizontal axis about which the two arms of the second shear are movable relative to each other.

11. The device according to claim 10, wherein the first bolt is connected to the two arms of the first shear and the second bolt is connected to the two arms of the second shear.

12. The device according to claim 10, wherein the at least one spring element is configured as a pressure spring washer through which the tension rod at last partially extends, wherein the counter bearing comprises a first counter element arranged at a first end region of the tension rod, and a second counter element arranged at an opposite second end region of the tension rod, wherein the at least one spring element is tensioned between the first counter element and the first bolt.

13. The device according to claim 12, wherein a distance between the first counter element and the second counter element is variable in order to adjust pretensioning of the at least one spring element.

14. The device according to claim 12, wherein the spring mechanism comprises at least one first spring element and at least one second spring element, each configured as a pressure spring washer, wherein the at least one first spring element is arranged between the first counter element and the first bolt and the at least one second spring element is arranged between the second counter element and the second bolt.

15. The device according to claim 14, wherein a first spring housing connected to the first bolt is provided in which the at least one first spring element is accommodated, and wherein a second spring housing connected to the second bolt is provided in which the at least one second spring element is accommodated.

* * * * *